US008867752B2

(12) United States Patent
Virette et al.

(10) Patent No.: US 8,867,752 B2
(45) Date of Patent: Oct. 21, 2014

(54) RECONSTRUCTION OF MULTI-CHANNEL AUDIO DATA

(75) Inventors: David Virette, Munich (DE); Pierrick Philippe, Melesse (FR)

(73) Assignee: Orange, Paris (FR)

( * ) Notice: Subject to any disclaimer, the term of this patent is extended or adjusted under 35 U.S.C. 154(b) by 777 days.

(21) Appl. No.: 13/056,169

(22) PCT Filed: Jul. 3, 2009

(86) PCT No.: PCT/FR2009/051304

§ 371 (c)(1),
(2), (4) Date: Jan. 27, 2011

(87) PCT Pub. No.: WO2010/012927

PCT Pub. Date: Feb. 4, 2010

(65) Prior Publication Data

US 2011/0129092 A1 Jun. 2, 2011

(30) Foreign Application Priority Data

Jul. 30, 2008 (FR) ..... 08 55249

(51) Int. Cl.

| | |
|---|---|
| ***H04R 5/00*** | (2006.01) |
| ***G10L 19/00*** | (2013.01) |
| ***G10L 21/00*** | (2013.01) |
| ***G10L 19/008*** | (2013.01) |
| ***H04S 3/02*** | (2006.01) |
| ***G10L 19/005*** | (2013.01) |

(52) U.S. Cl.

CPC ..... *G10L 19/008* (2013.01); *H04R 2420/03* (2013.01); *H04S 3/02* (2013.01); *G10L 19/005* (2013.01)

USPC ..... 381/22; 704/200.1; 704/500

(58) Field of Classification Search

USPC ..... 381/17, 22; 704/200.1, 500

See application file for complete search history.

(56) References Cited

U.S. PATENT DOCUMENTS

| | | | | |
|---|---|---|---|---|
| 6,006,173 | A * | 12/1999 | Wiese et al. | 704/201 |
| 6,181,800 | B1 * | 1/2001 | Lambrecht | 381/310 |
| 6,360,200 | B1 * | 3/2002 | Edler et al. | 704/219 |
| 6,490,551 | B2 * | 12/2002 | Wiese et al. | 704/201 |
| 6,614,767 | B1 * | 9/2003 | Marko et al. | 370/321 |
| 6,990,151 | B2 * | 1/2006 | Kim et al. | 375/240.27 |
| 7,974,847 | B2 * | 7/2011 | Kjoerling et al. | 704/500 |
| 2005/0182996 | A1 | 8/2005 | Bruhn | |

* cited by examiner

*Primary Examiner* — Davetta W Goins
*Assistant Examiner* — Daniel Sellers
(74) *Attorney, Agent, or Firm* — Drinker Biddle & Reath LLP

(57) ABSTRACT

A method for processing sound data is provided for the reconstruction of multi-channel audio data on the basis at least of data on a reduced number of channels and of spatialization data. A test is carried out to determine whether the spatialization data received are valid. If the test is positive, a spatialization value is predicted according to a per respective model of a plurality of models. A prediction model is chosen on the basis of the spatialization values thus predicted and on the basis of the spatialization data received, to permit, in case of subsequent reception of defective spatialization data, a prediction according to this chosen model of a spatialization value and to use this predicted spatialization value for the reconstruction of the multi-channel audio data.

11 Claims, 4 Drawing Sheets rcpt ILD'(b), M'(k)
305
ILD'(b) OK?
306
N
$M_R(k), M_L(k)$
301
$W_L^{(m*)}, W_R^{(m*)}$
310
$W_L', W_R'$
302
$W_L, W_R$
304
m:=1
$W_L^{(m)}, W_R^{(m)}$
307
m++
$\sigma^2_{L,m}, \sigma^2_{R,m}$
308
N
m==MAX ?
m*
309
$S_L'^{(k)}; S_R'^{(k)}$
300

RECONSTRUCTION OF MULTI-CHANNEL AUDIO DATA

CROSS-REFERENCE TO RELATED APPLICATIONS

This application is the U.S. national phase of the International Patent Application No. PCT/FR2009/051304 filed Jul. 3, 2009, which claims the benefit of French Application No. 08 55249 filed Jul. 30, 2008, the entire content of which is incorporated herein by reference.

FIELD OF THE INVENTION

The invention pertains to the concealment of defective spatialization data, for the reconstruction of multi-channel audio data. Multi-channel audio data are typically reconstructed on the basis at least of spatialization data and of audio data on a restricted number of channels, for example mono-channel data.

BACKGROUND

Multi-channel audio data are typically intended for several respective audio tracks. Several respective sound sources may be used to help to afford the listener the illusion of surround sound.

Multi-channel audio data may for example comprise stereo data on two channels, or else 5.1 data on six channels, in particular for Home Cinema applications. The invention can also find an application in the field of spatialized audio conferences, where the data corresponding to a speaker undergo spatialization processing so as to afford the listener the illusion that this speaker's voice is originating from a particular position in space.

Spatialization data are used to obtain multi-channel data on the basis of the data on a smaller number of channels, for example mono-channel data. These spatialization data can for example comprise differences of inter-pathway level or ILDs ("Interchannel Level Differences"), inter-pathway correlations or ICCs ("Interchannel Cross Correlations"), delays between pathways or ITDs ("Interchannel Time Differences"), phase differences between pathways or IPDs ("Interchannel Phase Differences"), or the like.

It may happen that audio data received, comprising at least the mono-channel data and the spatialization data, are defective, that is to say certain data are missing, or else erroneous.

The detection of this defective transmission may be performed by way of a code of CRC ("Cyclic Redundancy Check") type.

It is known to alleviate these defects by replacing defective values with predicted values. These predicted values may be determined in accordance with a known prediction model.

Several prediction models are known. For example, one chooses as predicted value an arbitrary value, a previous value, a value determined on the basis of the audio data previously received in accordance with for example methods of linear prediction, or the like.

When mono-channel data are received in a defective manner, the replacing of the defective values with predicted values of mono-channel data turns out in general to be relatively satisfactory.

However, when spatialization data are received in a defective manner, the replacing of the defective values with predicted values may turn out to be unsatisfactory.

Strong variations of the spatialization data over time are manifested for the listener by the sensation of abrupt displacements of the sound sources.

For example, if defective values are replaced with an arbitrary value corresponding to an absence of spatialization, the sensation of returning to a mono-channel sound may be disruptive for the listener, in particular in the case of binaural signals. Indeed, binaural signals, that is to say allowing faithful playback in 3D space at the level of the ears, often correspond to virtual sound sources relatively fixed in space.

There therefore exists a requirement for better concealment of the defects of spatialization data during the reconstruction of multi-channel audio data.

SUMMARY

According to a first aspect, the subject of the invention is a method for processing sound data, for the reconstruction of multi-channel audio data on the basis at least of data on a restricted number of channels and of spatialization data, this method comprising a step of testing the validity of spatialization data of a frame received. If this test shows that these spatialization data are valid:

a/ per respective model of a plurality of prediction models, a spatialization value is predicted according to this model, b/ a prediction model is chosen, on the basis of the spatialization values thus predicted and on the basis of the spatialization data actually received, so as to be able, in case of subsequent reception of defective spatialization data, to predict according to this chosen model a spatialization value, and to use this predicted spatialization value for the reconstruction of the multi-channel audio data.

Thus, spatialization data considered to be valid are used to choose from among a plurality of prediction models a prediction model to be adopted in case of reception of spatialization data considered to be defective. Such a method, which is adaptive depending on the content, makes it possible to alleviate the defects of the spatialization data in a more satisfactory manner than in the prior art where a single prediction model is used.

The expression "a restricted number of channels" is understood to mean a smaller number of channels than the number of channels of the multi-channel data. For example, the data on a restricted number of channels can comprise mono-channel data.

The spatialization data, and more generally the audio data received, may originate from a transmission channel. For example, these data may be received via the Internet. Alternatively, the audio data received may be read from a storage medium, for example a DVD ("Digital Versatile Disk"), or the like. The invention is in no way limited by the origin of the audio data received.

The audio data received can comprise a coded signal, a demultiplexed and/or decoded signal, numerical values, or the like.

Steps a/ and b/ may be performed systematically following the reception of a frame considered to be valid. The various processing is thus distributed over time.

Provision may be made, in particular when steps a/ and b/ are performed for each valid frame, to write to memory an identifier of the chosen prediction model, so as to be able, in case of subsequent reception of defective spatialization data, to rapidly retrieve the prediction model to be applied.

Alternatively, the execution of steps a/ and/or b/ may be subject to the realization of certain conditions, and this may make it possible to avoid performing irrelevant calculations.

For example, when a frame is considered to be valid, the spatialization data are stored in a memory, at least in a temporary manner. Steps a/ and b/ are performed (on the basis of the data thus stored), only in case of subsequent reception of spatialization data considered to be defective. This therefore avoids performing in particular the predictions of step a/ when such is not necessary.

According to another example, provision may be made to perform the predictions of step a/ systematically following the reception of a frame considered to be valid, while step b/ is performed (on the basis of the spatialization data of the previous frame or frames, preserved in memory) only in the case of receiving a defective frame.

Advantageously, during step b/, each predicted spatialization value is contrasted with a value estimated on the basis of the spatialization data received. In particular, provision may be made to calculate, per model, a resemblance value on the basis on the one hand of the spatialization value predicted in accordance with this model, and on the other hand of a value estimated on the basis of the spatialization data received. The prediction model for which the resemblance value indicates a greater fit between the predicted value and the estimated value is then chosen.

The estimated value may be one of the spatialization data, for example the estimated value can comprise an ILD. In this case, provision may be made, during step b/ to compare the predicted spatialization values directly with spatialization data received.

Alternatively, the estimated value may derive solely from the spatialization data. For example the estimated value can comprise a gain arising from the ILDs for a frame and a band of frequencies that are given, a delay, or the like. In this case, provision may be made, during step b/ to compare the predicted spatialization values with values obtained on the basis of spatialization data received.

Advantageously, for at least one model, previously predicted spatialization values are furthermore contrasted with corresponding estimated values. Thus, the choice of the prediction model that is the best fit with the content may be performed more appropriately.

For example, it is possible to use the spatialization data received on several frames, and to contrast for several frames the predicted values and the estimated values.

In particular, per frame of a sequence of frames received, and for at least one model, it is possible to predict a spatialization value in accordance with this model, so that a sequence of spatialization values is predicted. For this model, the resemblance value may be calculated on the basis on the one hand of this sequence of predicted spatialization values, and on the other hand of a sequence of values estimated on the basis of the data of the sequence of frames.

Advantageously, defective spatialization data will not be used during the prediction model choice step, so as avoid falsifying this choice.

Alternatively, it is possible to make do with the current spatialization data, received for example in one and the same frame, for the choice of the prediction model.

The data may be defective on account of degradations introduced during transmission, or of degradations of a data storage medium. The invention is not limited to this cause of defects. For example, in the case of a transmission hierarchized in layers (or "scalable coding" as it is called) for which a sender or another element of a transmission network may choose not to transmit a set of data, some data may be missing from among the spatialization data received.

The defective nature of the spatialization data may be detected in accordance with known methods, for example by way of a code of CRC type.

The invention is in no way limited by the form of the writing to memory of the identifier of the chosen prediction model. It is for example possible to copy all the instructions of a program corresponding to this model into a program memory, or quite simply to store a model name in a memory, optionally volatile.

During step a/, the prediction of the spatialization value is performed in accordance with a prediction model, that is to say in particular that the data used for the prediction can vary in accordance with the model. For example, for a model which consists in assigning an arbitrary value to the spatialization value, no datum is necessary for prediction. For a model which consists in re-employing a previous spatialization value, and/or in weighting a previous spatialization value, this previous spatialization value is used during prediction.

Advantageously, step a/ is performed for spatialization data corresponding to a given frequency band. Thus several predictions may be conducted in parallel, in various frequency bands. Indeed, in the case of a stereo signal, the choice of the most appropriate prediction model may be related to the frequency: one may be led to choose different prediction models in accordance with the frequency band considered.

According to another aspect, the subject of the invention is a computer program comprising instructions for the implementation of the method set forth hereinabove, when these instructions are executed by a processor.

According to yet another aspect, an aspect of the invention is a device for concealing defective spatialization data. This device comprises a memory unit, which can comprise one or more memories, for storing a plurality of suites of instructions, each suite of instructions corresponding to a prediction model. This device furthermore comprises reception means for receiving spatialization data. A test module makes it possible to test the validity of the spatialization data received by the reception means. In the case of reception of spatialization data detected as valid by the test module, an estimation module makes it possible, per suite of instructions stored in the memory unit, to execute this suite of instructions so as to predict a spatialization value. A selection module makes it possible to choose a prediction model, on the basis of the spatialization values predicted by the estimation module and on the basis of the spatialization data received by the reception means. The concealment device furthermore comprises a prediction module designed to, in case of reception of spatialization data considered to be defective by the detection module, predict according to the model chosen by the selection module a spatialization value.

According to yet another aspect, the subject of the invention is an apparatus for reconstructing multi-channel audio data. This apparatus comprises means of multi-channel reconstruction, for reconstructing multi-channel audio data on the basis at least of data on a restricted number of channels, for example mono-channel data. This apparatus furthermore comprises the concealment device described hereinabove. The prediction module is designed to, in case of reception of spatialization data considered to be defective by the detection module, provide the predicted spatialization value to the means of multi-channel reconstruction for the reconstruction of the multi-channel audio data.

The apparatus for reconstructing multi-channel audio data may be integrated into a processor, or else comprise an apparatus of computer or Hi-Fi system type, or the like.

The various hardware items of the reconstruction apparatus, for example the reconstruction means, the concealment device, the detection module, or the like, may be separate or merged.

BRIEF DESCRIPTION OF THE DRAWINGS

Other features and advantages of the present invention will be apparent in the description detailed hereinafter, given with reference to the appended drawings in which.

Identical references denote objects which are identical or similar from one figure to another.

DETAILED DESCRIPTION

In the examples illustrated by the figures, the number of channels of the multi-channel audio data is exactly two, but it is of course possible to provide more thereof. The multi-channel audio data can for example comprise 5.1 data on six channels. The invention can also find an application in the field of spatialized audio conferences.

In particular, reference may be made to the MPEG Surround standard, that is to say a tree structure may be used or simulated to generate more than 2 pathways.

In the examples represented, the audio data are grouped together in frames or packets, indexed n.

Figure 1:
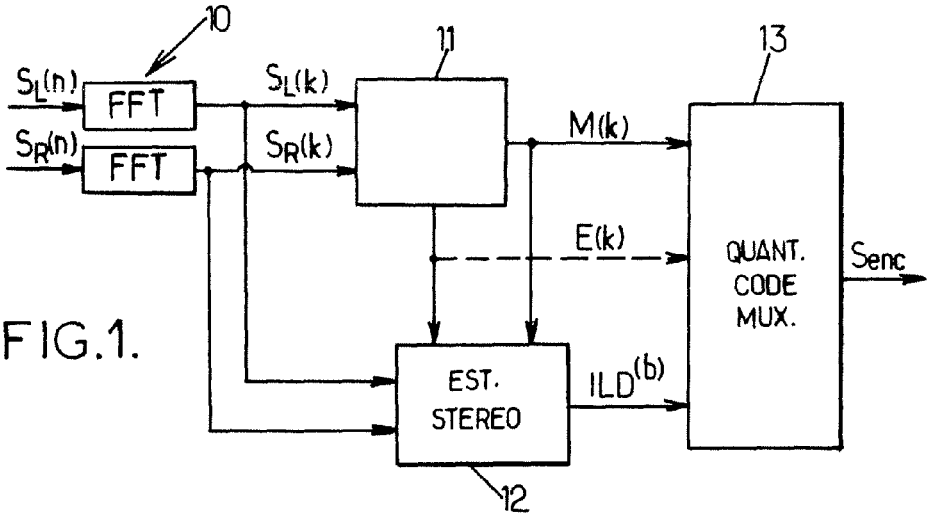
FIG. 1 shows an exemplary conversational coding device.

FIG. 1 shows an exemplary coder, for which stereo information is transmitted by frequency bands and is applied in the frequency domain.

For this purpose, the coder integrates time frequency transformation means 10, for example a DSP ("Digital Signal Processor") able to carry out a transform, for example be a Discrete Fourier Transform or DFT, an MDCT transform ("Modified Discrete Cosine Transform"), an MCLT transform ("Modulated Complex Lapped Transform").

Values of frequency signals $S_L(k)$ and right $S_R(k)$ are thus obtained on the basis of the values $S_L(n)$, $S_R(n)$ corresponding to the left and right temporal signals.

A matrixing is thereafter applied to the signals of the left $S_L(k)$ and right $S_R(k)$ pathway, by matrixing means 11.

These means 11 make it possible to determine on the basis of the stereo signal $S_L(k)$, $S_L(k)$, a mono-channel signal M(k) and a residual signal E(k). The mono-channel signal M(k) is typically the half-sum of the left $S_L(k)$ and right $S_R(k)$ signals. The residual signal E(k) may be equal to half the difference between the left $S_L(k)$ and right $S_R(k)$ signals.

Provision may be made for the matrixing to be adaptive so that the mono-channel signal M(k) transports more information. For this purpose the method implemented by the matrixing means 11 can evolve over time, so as to avoid cancelling components which would be in phase opposition between the left and right pathways.

Means for estimating spatialization data 12 make it possible to estimate spatialization data, for example stereo parameters, on the basis of the mono-channel signal M(k) and of the residual signal E(k). These stereo parameters may be known to the person skilled in the art, and may comprise for example differences of inter-pathway level (ILDs), inter-pathway correlations (ICCs) and delays or phase differences between pathways (IPDs/ITDs).

These stereo parameters $ILD^{(b)}$ may be determined by frequency bands, indexed by the variable b. These bands may be constituted according to a frequency scale which is close to human perception. For example, it is possible to use between 8 and 20 frequency bands, depending on the accuracy desired and the richness of the spectrum considered.

Quantization, coding and multiplexing means 13 make it possible to quantize and code the stereo parameters $ILD^{(b)}$ so as to allow transmission at a reduced throughput.

The mono-channel signal M(k) is also quantized and coded by the means 13, in the transformed domain as presented in FIG. 1, or alternatively in the time domain. It is possible to use standardized algorithms to process this mono-channel signal M(k), for example a speech coder of ITU G.729.1 or G.718 type. It may also be a generic audio coder of MPEG-4 AAC or HE-AAC type.

The residual signal E(k) is optionally transmitted, also calling upon standardized coding or a transmission technique specific to this signal in the frequency or time domain.

The encoded signal $S_{enc}$ obtained as output from the quantization, coding and multiplexing means 13 is transmitted, for example by radio pathway.

Alternatively, provision could be made for the coder to lead to data being obtained on more than one monophonic channel, provided that the number of channels of the data obtained as output from the coder is smaller than the number of channels of the data input to the coder.

Figure 2:
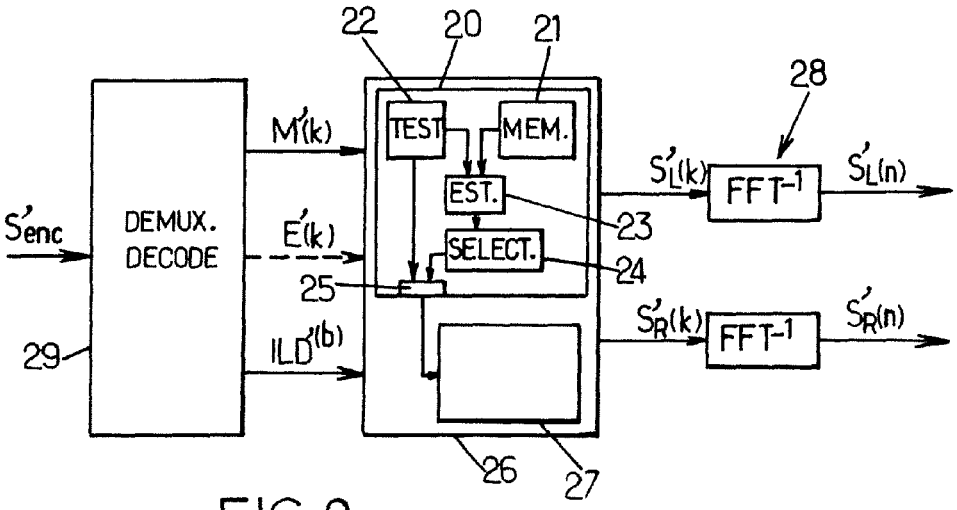
FIG. 2 shows an exemplary decoding device comprising an exemplary reconstruction apparatus according to one embodiment of the invention.

FIG. 2 shows an exemplary decoder liable to receive a signal $S'_{enc}$ corresponding to the signal $S_{enc}$ transmitted.

Decoding and demultiplexing means 29 make it possible to extract from the signal $S'_{enc}$ received from the mono-channel data M'(k), spatialization data $ILD'^{(b)}$, as well optionally as residual data E'(k).

The decoder furthermore comprises a reconstruction apparatus 26 for reconstructing multi-channel audio data $S'_L(k)$, $S'_R(k)$, on the basis of the mono-channel data M'(k), spatialization data $ILD'^{(b)}$, and optional residual data E'(k).

Figure 3:
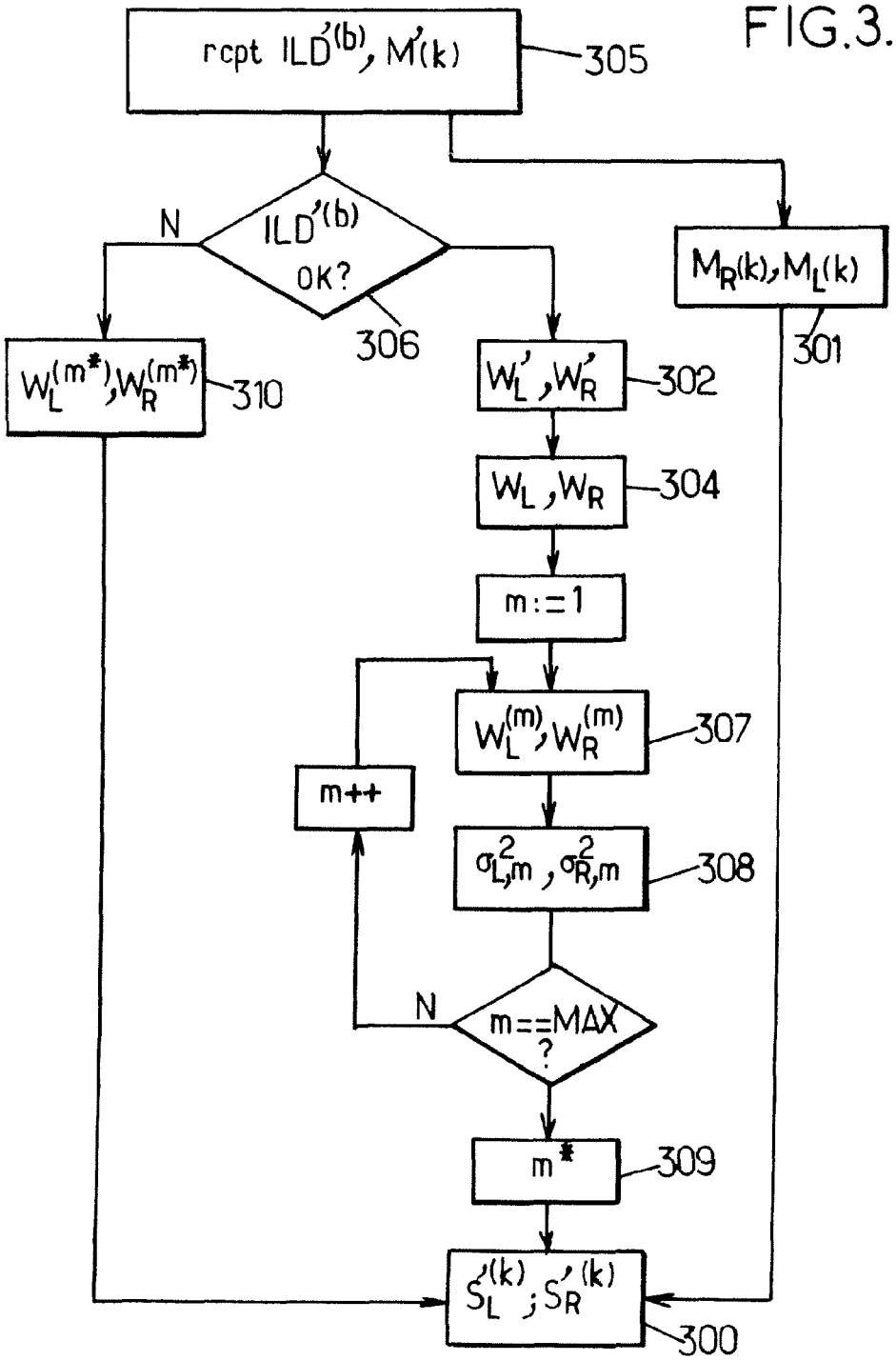
FIG. 3 is an exemplary algorithm of a method according to one embodiment of the invention.

FIG. 3 shows an algorithm executable by the reconstruction apparatus 26 of FIG. 2. These two figures will therefore be commented on simultaneously.

The reconstruction apparatus 26 comprises a concealment device 20 for providing replacement values in the case of defective spatialization data $ILD'^{(b)}$, and means of multi-channel reconstruction 27 for the reconstruction proper.

The means of multi-channel reconstruction 27 can for example, during a step 300, perform combinations of the type:

$$\begin{cases} S'_L(k) = E'_L(k) + W_L(b, n) \cdot M_L(k) \\ S'_R(k) = E'_R(k) + W_R(b, n) \cdot M_R(k) \end{cases}$$

Where k denotes the frequency index considered, b denotes the band assigned by the transmitted stereo parameters, $M_L(k)$, a signal in the frequency domain, obtained during a step 301 on the basis of the mono-channel data M'(k), by applying in a manner known to the person skilled in the art a phase shift or a delay corresponding to the left pathway, this phase shift or this delay being obtained from spatialization data (not represented), and $M_R(k)$, a signal in the frequency domain, obtained in an equivalent manner during step 301, for the right pathway.

In particular, if no phase shift is applied, then $$M_R(k)=M_L(k)=M'(k).$$

$E'_L$ is a signal specific to the left pathway, arising in a way known to the person skilled in the art from the residual data E'(k) optionally transmitted, and $E'_R$, a signal specific to the right pathway, arising in a way known to the person skilled in the art from the residual data E'(k) optionally transmitted. The step of obtaining the data $E'_L$, $E'_R$ is not represented in FIG. 3.

In the case of non-transmission of residual data:

$$E'(k),E'_L=E'_R=0.$$

$W_L$ and $W_R$ are the gains arising from spatialization data ILD'(b,n) for the band b considered and the frame n.

The gains $W_L$ and $W_R$ can for example be determined as follows, by way of values $W'_L$ and $W'_R$, during a step 302:

$$W'_L(b,n)=\frac{2\cdot ILD'(b,n)}{1+ILD'(b,n)}$$

$$W'_R(b,n)=\frac{2}{1+ILD'(b,n)}$$

Where ILD'(b,n) is the spatialization datum $ILD'^{(b)}$ received for frame n.

A smoothing with a time constant α between 0 and 1, for example α=0.8, is then performed during a step 304 in accordance with:

$W_L(b,n)=\alpha\cdot W'_L(b,n)+(1-\alpha)\cdot W_L(b,n-1)$, where $W_L(b,n-1)$ denotes the value obtained for the previous frame.

For the right pathway, it is possible to perform the same smoothing during step 304:

$W_R(b,n)=\alpha\cdot W'R(b,n)+(1-\alpha)\cdot W_R(b,n-1)$, where $W_R(b,n-1)$ denotes the value obtained for the previous frame.

Alternatively, it is possible to use the value obtained for the left pathway, according to for example:

$$W_R(b,n)=2-W_R(b,n)$$

The concealment device 20 makes it possible to avert possible losses of data ILD'(b,n), so that data $W_R$ and $W_L$ can be determined despite everything.

The concealment device 20 comprises reception means (not represented) for receiving during a step 305 the spatialization data ILD'(b,n), as well optionally as the mono-channel data M'(k), and the residual data E'(k).

These reception means can for example comprise an input port, input pins, or the like.

A test module 22 linked to these reception means makes it possible to test during a step 306 the validity of the spatialization data $ILD'^{(b)}$. This test module can implement a verification of an encoding of CRC type, to verify for example, that the transmission has not given rise to any degradation of the spatialization data.

The test module 22 can also read certain values (not represented) extracted from the signal $S'_{enc}$ received, these values indicating possible deletions of layers of data transmitted. Indeed, provision may be made for certain elements of the transmission network to refrain from transmitting, in particular in the case of clogging of the network, or of reduction in the bandwidth of the transmission channel, such and such a data set. The data sets not transmitted can correspond to sound details for example. When the test module 22 reads a value indicating a deletion of certain data, these data are considered to be missing.

The concealment device 20 comprises a memory unit 21 storing several suites of instructions, each suite of instructions corresponding to a prediction model.

For example, in accordance with a first prediction model, when spatialization data ILD'(b,n) are defective for a frame n and a given frequency band b, we choose $$W_L^{(1)}(b,n)=W_L(b,n-1)$$

$$W_R^{(1)}(b,n)=W_R(b,n-1)$$

The corresponding instructions then consist in copying the values $W_R(b,n-1)$, $W_L(b,n-1)$ obtained for the previous frame.

For example, in accordance with a second prediction model, we choose $$W_L^{(2)}(b,n)=\beta+(1-\beta)\cdot W_L(b,n-1),\text{ and}$$

$$W_R^{(2)}(b,n)=\beta+(1-\beta)\cdot W_R(b,n-1),\text{ with }\beta\text{ between 0 and 1.}$$

Thus, in the case of a succession of frames for which some spatialization data are defective, $W_L^{(2)}(b,n)$ and $W_R^{(2)}(b,n)$ tend to 1, and consequently the multi-channel audio data $S'_L(k)$, $S'_R(k)$ approach the mono-channel data M'(k). Stated otherwise, the spatialization effects are gradually expunged to get back to a mono-channel signal.

According to another exemplary prediction model, we choose $$W_L^{(3)}(b,n)=2\cdot W_L(b,n-1)\cdot W_L(b,n-2),\text{ and}$$

$$W_R^{(3)}(b,n)=2\cdot W_R(b,n-1)\cdot W_R(b,n-2).$$

Or else:

$$W_L^{(4)}(b,n)=\frac{1}{2}\cdot W_L(b,n-1)+\frac{1}{2}W_L(b,n-2),\text{ and}$$

$$W_R^{(4)}(b,n)=\frac{1}{2}\cdot W_R(b,n-1)+\frac{1}{2}W_R(b,n-2).$$

Or else a median filter is used:

$$W_L^{(5)}(b,n)=\text{Median}(W_L(b,n-1),W_L(b,n-2),\ldots),\text{ and}$$

$$W_R^{(5)}(b,n)=\text{Median}(W_R(b,n-1),W_R(b,n-2),\ldots).$$

Optionally, to ensure better stability, attenuated values, for example $0.9\cdot W_L(b,n-i)$ and $0.9\cdot W_R(b,n-i)$ will be used in place of $W_L(b,n-i)$ and $W_R(b,n-i)$ respectively. Provision may be made for these attenuated values to be preserved in the memory unit, so as to use them directly by applying one of the models set forth hereinabove.

Other models are also possible, for example a more general prediction of the form $$W_L^{(m)}=\sum_{i=1}^{P}a_i\cdot W_L(b,n-i)\text{ and }W_R^{(m)}=\sum_{i=1}^{P}a_i\cdot W_R(b,n-i),$$

with an order of prediction P is possible. The coefficients $\alpha_i$ can evolve over time, and be re-updated using a scheme of Levinson-Durbin type.

These examples of models lead to the prediction of values of $W_L$ and $W_R$. Alternatively, the models can make it possible to predict values of the variables ILD'(b,n), of $W'_L$ and $W'_R$, or the like.

For example, in accordance with a prediction model equivalent to the first model set forth hereinabove, when spatialization data ILD'(b,n) are missing for a frame n and a given frequency band b, we choose ILD'(b,n)=ILD'(b,n−1). The corresponding instruction then consists in copying this value ILD'(b,n−1) obtained for the previous frame.

An estimation module 23 makes it possible to execute the instructions of the various instruction suites. This module 23 is activated for example for each frame such that the corresponding spatialization data ILD'(b,n) are considered to be valid by the test module 22, or else only for the frames considered to be valid and which precede a frame considered to be defective.

When this module 23 is activated, all the stored suites of instructions are executed, during steps 307 repeated in a loop traversing the suites of instructions, with the conventional steps of initialization, testing and incrementation, so as to obtain a set of values $\{W_L^{(m)}, W_R^{(m)}\}$, m indexing the model used.

A selection module 24 makes it possible to choose one of these models by contrasting the spatialization values predicted $\{W_L^{(m)}, W_R^{(m)}\}$ with spatialization values estimated $W_L$, $W_R$ on the basis of the spatialization data actually received ILD'(b,n).

For example, for each model, it is possible, during steps 308, to calculate resemblance values $\sigma_{L,m}^2$, $\sigma_{R,m}^2$ on the basis of predicted values $W_L^{(m)}(b,n)$, $W_R^{(m)}(b,n)$ and on the basis of estimated values $W_L(b,n)$, $W_R(b,n)$. The resemblance values can for example comprise the variance of each prediction:

$\sigma_{L,m}^2 = E[(W_L(b,n) - W_L^{(m)}(b,n))^2]$, E representing mathematical expectation, according to for example:

$$E[x^2] = \frac{1}{N}\sum_{n=0}^{N-1} x^2(n)$$

A sequence of N frames received is thus used to determine N values $W_L^{(m)}(b,n)$ and to compare them with N estimated values $W_L(b,n)$.

An equivalent formula is applied for the right pathway.

Alternatively, provision may be made to calculate a variance recursively, for example in accordance, for each pathway, with:

$\sigma_{m,n}^2 - \alpha \cdot \sigma_{m,n-1}^2[x^2] + (1-\alpha) \cdot x^2(n)$ where here $\alpha$ is a time constant for example equal to 0.975, and $\sigma_{m,n}^2$ denotes the estimation of the variance at frame n.

According to an alternative embodiment (not represented), instead of estimating the variance, we estimate a likelihood of the data $W_L^{(m)}, W_R^{(m)}$ in relation to the data $W_L$, $W_R$ obtained on the basis of the values actually received. It is for example possible to use a set of estimators:

$$P_m^L = P(W_L^{(m)}(b,n)/W_L(b,n)) \text{ and}$$

$$P_m^R = P(W_R^{(m)}(b,n)/W_R(b,n)).$$

By comparing the estimators of type $\sigma_m^2$ or $P_m$, it is possible to choose the prediction model for which the resemblance value indicates a greater fit between predicted values and estimated values. For example, the index m* of the model giving the best concealment is determined: this will be the index which will minimize $\sigma_m^2$ or will maximize $P_m$ in another embodiment.

For the sake of simplicity, provision may be made to choose the index which will minimize $\sigma_m^2$ on a single of the pathways, for example the left pathway.

This value m* constitutes an identifier of the chosen prediction model and is stored in the memory unit 21 during a step 309.

It is clear that steps 307 may be executed before steps 302, 304, or else in parallel. Each step 308 here involves values obtained during step 304, and is therefore executed subsequent to this step 304.

The concealment device 20 furthermore comprises a prediction module 25, for, in case of reception of spatialization data considered to be defective, predicting spatialization values $W_L^{(m*)}(b,n)$ and $W_R^{(m*)}(b,n)$ during a step 310 according to the model identified by the value m*.

This value is provided to the means of multi-channel reconstruction 27, which are then in a position to reconstruct the multi-channel data $S'_L(k)$, $S'_R(k)$ during step 300, despite the defects of the spatialization data.

Frequency-time transformation means 28, for example DSPs, make it possible to retrieve temporal audio data $S'_L(n)$, $S'_R(n)$ on the basis of the multi-channel data $S'_L(k)$, $S'_R(k)$ reconstructed.

Figure 4:
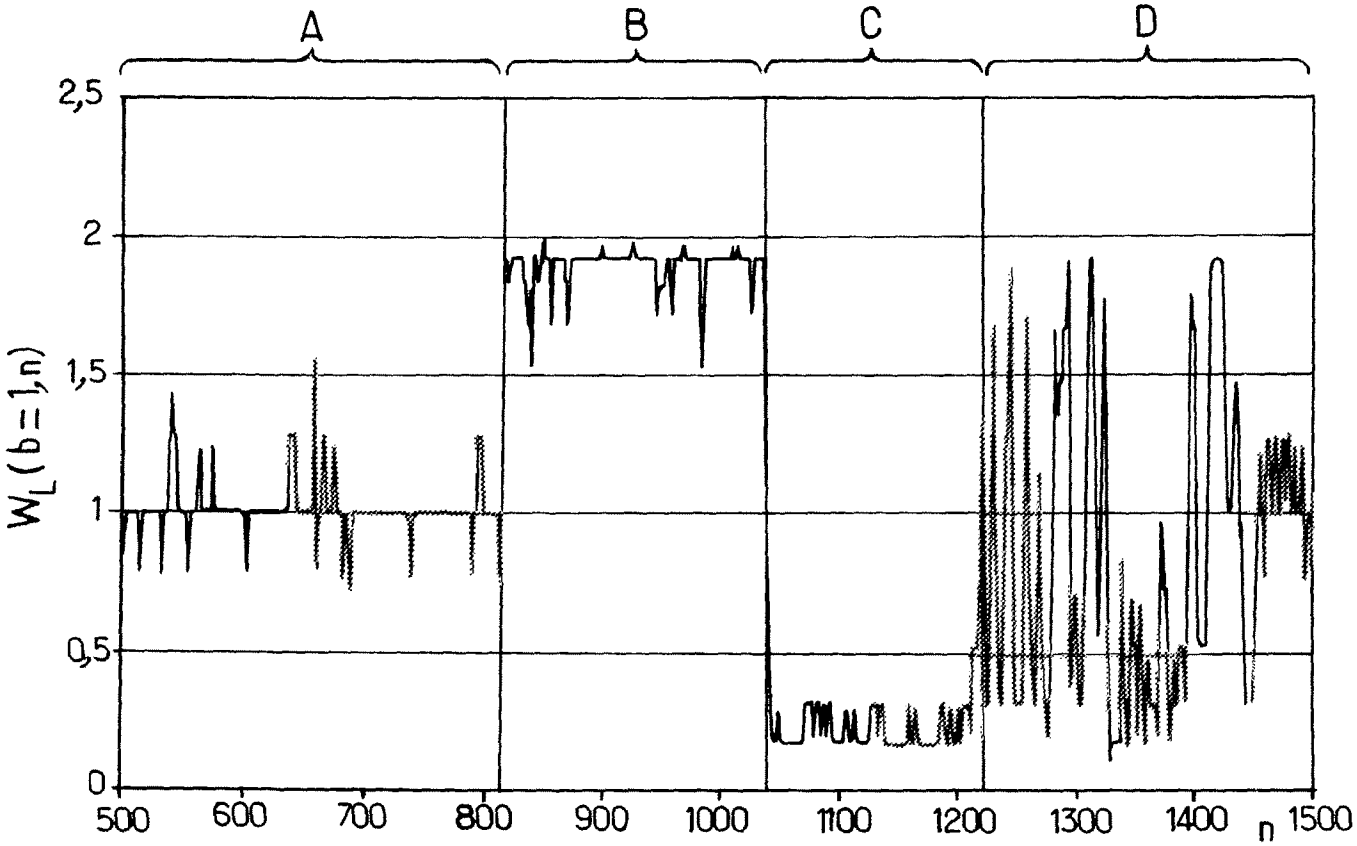
FIG. 4 is a graph showing an exemplary possible evolution of the gain.

FIG. 4 shows a plot representing an exemplary evolution of the value $W_L(b,n)$ for the second frequency sub-band, that is to say b=1. The frame index n appears as abscissa, and the values $W_L(1,n)$ as ordinate.

For portion A corresponding roughly to the frames between the $500^{th}$ and the $810^{th}$ frames, the values of $W_L(1,n)$ are for the most part equal to 1, thus corresponding to a relatively monophonic sound signal.

For portion B, the values of $W_L(1,n)$ correspond to a signal located on the left, while for portion C, the values of $W_L(1,n)$ correspond to a signal located on the right.

For portion D, the values of $W_L(1,n)$ correspond to a plurality of sound sources located at various places.

The best prediction model chosen can vary according to the type of variations of the gain.

Thus, for portion A, the model consisting in repeating the value obtained for the previous frame would lead to wrongly repeating the spikes of values of $W_L(1,n)$. A more judicious model would consist in choosing an arbitrary value corresponding to a mono-channel signal, or else in weighting the gain obtained for the previous frame so as to gradually approach a gain of 1.

On the other hand, for portions B and C, the most judicious approach may consist in repeating the gain value obtained for the previous frame.

For portion D, when the gain evolves relatively slowly, and therefore relatively predictably, a judicious approach would consist in performing a weighted mean of the gains obtained for P previous frames. When the stereo parameters evolve more rapidly, the most judicious approach would consist in returning to a mono-channel signal so as avoid any artifact.

Thus, the most judicious model can change according to the type of variations of the gain from one frame to another. The method of FIG. 3 makes it possible to select, without human intervention, the most suitable prediction model.

This selecting of the most suitable prediction model makes it possible to obtain concealment of better quality in the case of defective data.

Figure 5:
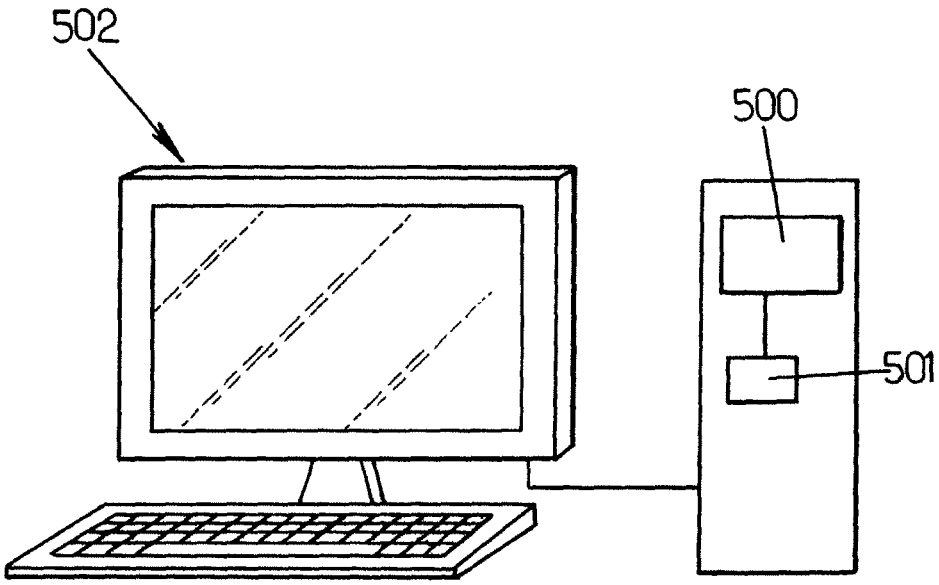
FIG. 5 shows a device able to execute a computer program according to one aspect of the invention.

FIG. 5 shows a computer comprising a screen 502, a keyboard, and a central unit. This central unit comprises a memory 500 for storing a computer program comprising instructions corresponding to the steps of the method described hereinabove. This central unit furthermore comprises a processor 501 linked to the memory 500, for executing these instructions.

The invention claimed is:

1. A method for processing sound data, for the reconstruction of multi-channel audio data on the basis at least of data on a restricted number of channels and of spatialization data, said method comprising a step of testing validity of spatialization data of a frame received, and, if said test shows that said spatialization data received are valid, steps of:

a/ predicting, per a respective model of a plurality of prediction models, according to said model of a spatialization value, and b/ choosing a prediction model, based on the spatialization values thus predicted and based on the spatialization data received, so as to be able, in case of subsequent reception of defective spatialization data, to predict according to said chosen model a spatialization value and to use said predicted spatialization value for the reconstruction of the multi-channel audio data and, during step b/:

calculating for each model of the plurality of models, a resemblance value based on at least one of the predicted spatialization value in accordance with said model, and of an estimated value on the basis of the spatialization data received, and choosing the prediction model for which said resemblance value indicates a greater fit between the predicted spatialization value and said estimated value.

2. The method as claimed in claim 1, further comprising, if the test shows that the spatialization data received are valid, and prior to step a/, storing said valid spatialization data, and wherein step b/ is performed in case of subsequent reception of defective spatialization data, based on said stored spatialization data.

3. The method as claimed in claim 2, wherein step a/ is performed in case of subsequent reception of defective spatialization data, based on said stored spatialization data.

4. The method as claimed in claim 1, wherein steps a/ and b/ are systematically performed following the reception of a valid frame, the method furthermore comprising, following step b/, a step of writing to memory of an identifier of the chosen prediction model.

5. The method as claimed in claim 1, wherein the predicted spatialization value comprises a gain.

6. The method as claimed in claim 1, wherein the predicted spatialization value comprises a delay.

7. The method as claimed in claim 1, wherein during steps a/and b/:

per frame of a sequence of frames received, and for at least one model of the plurality of models, predicting a spatialization value according to said model, and, for said model, the resemblance value is calculated based on at least one of the sequence of predicted spatialization values in accordance with said model, and of a sequence of estimated values based on the spatialization data of the sequence of frames received.

8. The method as claimed in claim 1, wherein, step a/ is performed for spatialization data corresponding to a given frequency band (b).

9. A non-transitory computer program storage medium comprising instructions for the implementation of the method as claimed in claim 1, when said instructions are executed by a processor.

10. A device for concealing defective spatialization data, comprising:

a memory unit for storing a plurality of suites of instructions, each suite of instructions corresponding to a prediction model, a receiver for receiving spatialization data, a module for testing a validity of the spatialization data received by the receiver, an estimation module able to, in the case of reception of spatialization data detected as valid by the detection module, and per suite of instructions stored in the memory unit, execute said suite of instructions so as to predict a spatialization value, and a selection module for choosing a prediction model, based on the spatialization values predicted by the estimation module by calculating for each model of the plurality of models, a resemblance value based on at least one of the predicted spatialization value in accordance with said model, and of an estimated value based of the spatialization data received by the receiver, and by choosing the prediction model for which said resemblance value indicates a greater fit between the predicted spatialization value and said estimated value, the concealment device further comprising:

a prediction module designed to, in case of subsequent reception of spatialization data considered to be defective by the detection module, predict a spatialization value according to said model chosen by the selection module.

11. An apparatus for reconstructing multi-channel audio data, said apparatus comprising:

a multi-channel reconstructor for reconstructing multi-channel audio data based on at least of mono-channel data, and the concealment device as claimed in claim 10, wherein the prediction module is designed to, in case of reception of spatialization data considered to be defective by the detection module, provide the predicted spatialization value to the multi-channel reconstructor for the reconstruction of the multi-channel audio data.

* * * * *